United States Patent [19]

Ryan et al.

[11] 4,417,613

[45] Nov. 29, 1983

[54] UNIVERSAL PACIFIER CASE

[76] Inventors: Kathryn A. Ryan; Gregory F. Ryan, both of 77 Erie St., Dumont, N.J. 07628

[21] Appl. No.: 363,305

[22] Filed: Mar. 29, 1982

[51] Int. Cl.[3] ..... B65D 85/00; B65D 65/06; A61J 17/00

[52] U.S. Cl. ..... 150/52 R; 128/360; 206/438; 220/4 E; 220/339; 215/11 C

[58] Field of Search ..... 128/359, 360; 220/4 E, 220/4 B; 215/11 R, 11 C; 206/315 R, 438, 364; D24/45, 46, 47, 48; 150/52 R

[56] References Cited

U.S. PATENT DOCUMENTS

| | | | |
|---|---|---|---|
| 1,191,516 | 7/1916 | Keil | 215/11 C |
| 1,258,766 | 3/1918 | Gullery | 215/11 C |
| 2,764,308 | 9/1956 | Hoch | 220/4 E |
| 3,380,608 | 4/1968 | Morbeck | 220/4 E |
| 3,530,979 | 9/1970 | Merrill, Jr. et al. | 206/438 X |
| 3,940,873 | 3/1976 | Lawless | 206/315 X |
| 4,053,051 | 10/1977 | Brinkhoff | 206/438 |
| 4,329,996 | 5/1982 | Copeland | 128/360 X |

FOREIGN PATENT DOCUMENTS

| | | | |
|---|---|---|---|
| 19385 | 1/1936 | Australia | 128/360 |
| 1065055 | 12/1953 | France | 206/438 |
| 2,271,996 | 12/1975 | France | 220/4 E |

*Primary Examiner*—William Price
*Assistant Examiner*—Sue A. Weaver
*Attorney, Agent, or Firm*—Samuelson & Jacob

[57] ABSTRACT

A universal pacifier case provides a sanitary enclosure for baby pacifiers of the type having a nipple, a guard flange and a handle, the pacifier case including a housing fully enclosing the nipple and the guard flange, with the handle projecting out of the housing, the housing having a pair of wall members hinged together for opening and closing the housing about the pacifier, the wall members including interengaging dust-sealing members along the peripheral edges of the wall members and an aperture in the wall members having a configuration generally complementary to the handle of the pacifier so as essentially to seal the pacifier within the housing when the housing is closed about the pacifier.

14 Claims, 7 Drawing Figures

UNIVERSAL PACIFIER CASE

The present invention relates generally to baby pacifiers and pertains, more specifically, to a case for providing a protective, generally sanitary enclosure for a pacifier when the pacifier is not in use.

Baby pacifiers have been manufactured and sold in a wide variety of designs and styles; however, by far the most popular styles currently being made available are of the type having a nipple of rubber or a rubber-like material projecting in one direction from an integral guard flange and a handle projecting from the guard flange in the other direction. By the nature of the use of baby pacifiers, the nipple and guard flange portions tend to become wet, and sometimes sticky, and are susceptible to gathering dirt, lint, dust and other contaminants. Because it would be undesirable to introduce such contaminants into a baby's mouth, it would be helpful to have available an effective means for isolating the pacifier from these contaminants when the pacifier is not in use.

A variety of covers and shields have been suggested for use in connection with baby pacifiers to protect against various contaminants such as dirt, dust and lint. Among these are the devices shown in U.S. Pat. No. De. 243,366 to Lybe et al., U.S. Pat. No. De. 2,834,350 to Beck, Jr. et al. and U.S. Pat. No. De. 3,022,915 to Mullin. Each of these patents reveals a device having a cup-like element which is secured over a pacifier to protect the nipple of the pacifier. Numerous devices have been patented for protecting the nipples of baby feeding bottles, and these devices usually rely upon the structure of the bottle itself to cooperate with the device in fitting and holding the device in place over the nipple. One such device is illustrated in U.S. Pat. No. 1,258,766 to Gullery in which hinged sections of a nipple protector are closed over a nipple such that skirt portions of the sections engage the nipple between a bead on the nipple and a swell in the nipple formed by a bead on the bottle to secure the device in place upon the nipple and bottle assembly.

It is an object of the present invention to provide a protective, generally sanitary case for a pacifier, which case will enclose essentially completely the nipple and guard flange of the most prevalent styles of currently available pacifiers.

Another object of the invention is to provide a pacifier case of the type described and which accommodates any one of a plurality of styles of pacifier, the case including a sealing mechanism which maintains an essentially complete protective enclosure around the nipple and the guard flange of the pacifier.

Still another object of the invention is to provide a pacifier case of the type described and which enables the handle of the pacifier to project therefrom for ease of manipulation and handling, while still maintaining an essentially sealed enclosure around the nipple and the guard flange of the pacifier.

Yet another object of the invention is to provide a pacifier case of the type described and which locks positively around a pacifier, without the use of any externally protruding potentially hazardous locking elements.

A further object of the invention is to provide a pacifier case of the type described and which is simple in construction and use and may be fabricated economically in large numbers.

A still further object of the invention is to provide a pacifier case of the type described and which is manufactured readily in a unitary structure for ease of fabrication, packaging, sale and use.

Yet a further object of the invention is to provide a pacifier case of the type described and which is fabricated readily of non-toxic materials and which may be constructed in an aesthetically appealing configuration, as well as a configuration which eliminates any potentially hazardous feature, for enabling safe use.

The above objects, as well as still further objects and advantages, are attained by the present invention which may be described briefly as a pacifier case for providing a sanitary enclosure for a pacifier of the type having a nipple extending axially from one side of a radial guard flange and a handle extending from the other side of the guard flange, the pacifier case comprising: a unitary shell-like housing of molded synthetic resin extending axially between a first end and a second end, the housing establishing an enclosed chamber having a first portion, adjacent the first end, for receiving and enclosing the nipple of the pacifier and a second portion, adjacent the second end, for receiving and enclosing the guard flange of the pacifier; the housing including a pair of half-shell-like wall members having peripheral edges for engaging one another when in a closed position to establish the enclosed chamber; hinge means joining the wall members along a limited length of the peripheral edges for enabling parting of the wall members at the peripheral edges for selective movement of the wall members to an open position to open the chamber; the housing including radially-extending end wall portions adjacent the second end thereof; and an aperture in the end wall portions for enabling the handle of the pacifier to project axially through the aperture and outside the chamber beyond the end wall portions, when the wall members are in the closed position.

The invention will be understood more fully, while still further objects and advantages will be made apparent, in the following detailed description of a preferred embodiment of the invention illustrated in the accompanying drawing, in which.

Figure 1:
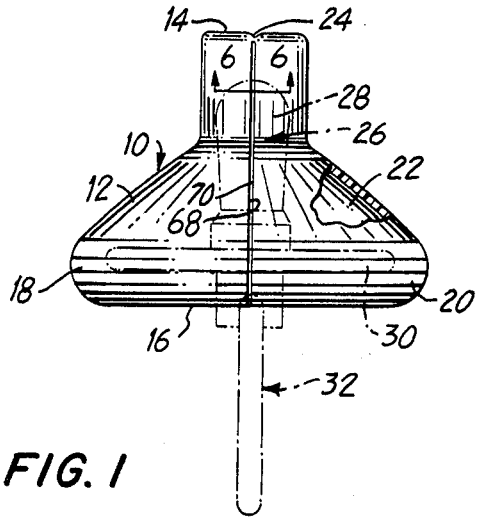
FIG. 1 is a side elevational view of a pacifier case constructed in accordance with the invention.
Figure 2:
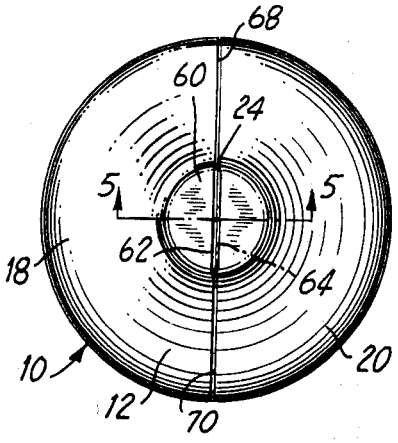
FIG. 2 is a top plan view of the pacifier case.

Referring now to the drawing, and especially to FIGS. 1 and 2 thereof, a pacifier case constructed in accordance with the invention is shown at 10 and is seen to include a shell-like housing 12 extending between a first end 14 and a second end 16. Housing 12 includes a pair of half-shell-like wall members 18 and 20 which, when in a closed position as depicted in FIGS. 1 and 2, establish an enclosed chamber 22 within the housing 12.

Figure 3:
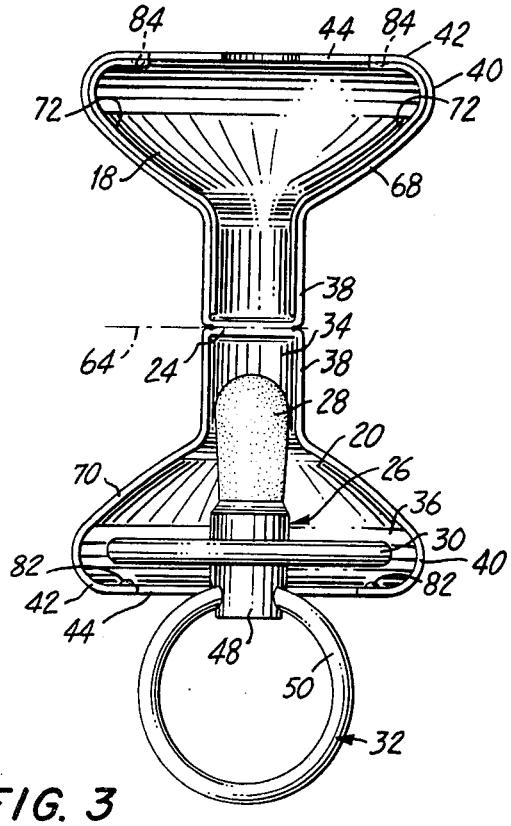
FIG. 3 is a side elevational view showing the pacifier case in an open position with a pacifier in place therein.

The wall members 18 and 20 are hinged together, preferably by a hinge 24 placed at the first end 14, so that the wall members 18 and 20 may be moved into an open position, as seen in FIG. 3, to open chamber 22 for the reception of a pacifier 26. Pacifier 26 is of the type which has a nipple 28 extending axially from one side of a radial guard flange 30, and a handle 32 extending axially from the other side of guard flange 30. Nipple 28 and guard flange 30 usually are fabricated of rubber, or a rubber-like material such as an elastomer, and are to be protected from dirt, lint, dust and other contaminants by being encased within housing 12. Chamber 22 has a first portion 34, for receiving the nipple 28 of the pacifier 26, and a second portion 36, for receiving the guard flange 30. Each wall member 18 and 20 has a semi-tubular axially-extending wall portion 38, for establishing first portion 34 of chamber 22, and a radially outwardly extending wall portion 40, for establishing second portion 36 of chamber 22. Thus, upon moving wall members 18 and 20 into the closed position, nipple 28 and guard flange 30 will be encased within the chamber 22 of housing 12, as seen in phantom in FIG. 1.

Figure 4:
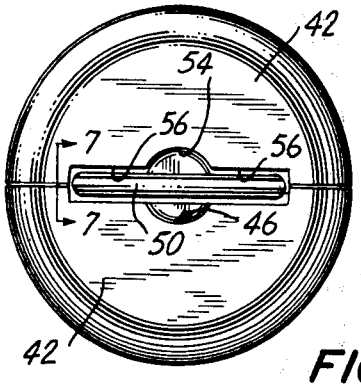
FIG. 4 is a bottom plan view of the pacifier case with a pacifier therein.

In order to enable ease of manipulation and handling, handle 32 of pacifier 26 projects beyond the housing 12 of pacifier case 10. Thus, as best seen in FIGS. 3 and 4, each wall member 18 and 20 includes a radially inwardly extending end wall portion 42 and each end wall portion 42 has a recess 44 such that when the wall members 18 and 20 are in the closed position, as seen in FIG. 4, the recesses 44 establish an aperture 46 through which handle 32 is allowed to pass.

Aperture 46 has a profile configuration generally complementary to the various shapes encountered in the handles of the most prevalent styles of available pacifiers. Pacifier 26 illustrates one of the more popular styles wherein handle 32 includes a shank 48 and a ring 50. Another popular style pacifier differs from pacifier 26 in that the handle includes no shank, but merely has a ring, (not shown) with a diameter greater than the diameter of ring 50. Thus, the profile configuration of aperture 46 has a generally circular opening 54 for accommodating a shank, such as shank 48, and elongate slots 56 for accommodating a ring, such as ring 50 or the aforesaid ring of greater diameter. Each recess 44 constitutes a symmetrical half of the profile configuration of aperture 46 so that housing 12 can be closed around a projecting handle of a pacifier while the nipple and guard shield of the pacifier effectively are sealed within the chamber 22 of the housing.

Figure 5:
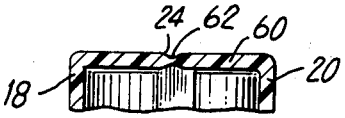
FIG. 5 is an enlarged fragmentary view taken along line 5—5 of FIG. 2.

Preferably, housing 12 is constructed of a non-toxic synthetic resin material and is molded in one piece, as by injection molding a thermoplastic synthetic resin. First end 14 of housing 12 is provided with a flat, essentially planar wall portion 60 which includes a straight line wall portion 62 of reduced wall thickness, best seen in FIG. 5, which serves as hinge 24. The placement and configuration of hinge 24 enables the wall members 18 and 20 to be moved between the open and closed positions about a transverse hinge axis 64 (see FIGS. 2 and 3) coextensive with hinge 24 and located between the wall members 18 and 20.

Figure 6:
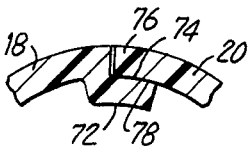
FIG. 6 is an enlarged fragmentary view taken along line 6—6 of FIG. 1.

In order to maintain an adequate seal between the wall members 18 and 20 when the wall members are in the closed position, the peripheral edges 68 and 70 of the respective wall members 18 and 20 are provided with sealing means. Thus, wall member 18 has integral sealing elements in the form of sealing members 72 projecting slightly inwardly, as seen in FIG. 6, along peripheral edge 68 and providing dust-sealing surfaces 74. Wall member 20 has integral sealing elements in the form of sealing portions 76 which provide dust-sealing surfaces 78 complementary with dust-sealing surfaces 74 such that engagement of the complementary dust-sealing surfaces 74 and 78 will establish an adequate seal against dust, dirt, lint and other contaminants. It is noted that the relative arrangement of the wall members 18 and 20 and hinge 24 assures that movement of the wall members 18 and 20 into the closed position is accomplished with ease and effects simultaneous proper engagement of the dust-sealing surfaces 74 and 78.

Figure 7:
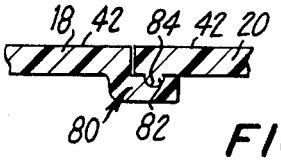
FIG. 7 is an enlarged fragmentary view taken along line 7—7 of FIG. 4.

Upon reaching the closed position, the wall members 18 and 20 are latched together by locking means shown in the form of detent catches 80 located along the peripheral edges 68 and 70 of the wall members. As best seen in FIG. 7, each catch 80 includes a detent projection 82 which is received within a complementary detent recess 84, by virtue of the resilience of the material of the wall members, to lock the wall members together. The detent catches 80 are disengaged selectively to move the wall members 18 and 20 to the open position. The elements of detent catches 80 protrude into the chamber 22 so that no potentially hazardous projection extends outwardly from the housing 12. Preferably, the detent catches 80 are located in end wall portions 42 so that as the wall members 18 and 20 are moved toward the closed position, the sealing members 72 will be engaged appropriately with sealing portions 76 before the detent projections 82 will engage detent recesses 84 to lock the wall members 18 and 20 together.

The arrangement of the wall members 18 and 20, the hinge 24, the dust-sealing means and the detent catches 80 provide a relatively smooth and uninterrupted external surface upon housing 12 which not only is aesthetically appealing but which enhances safety through the elimination of potentially hazardous projections and dirt-accumulating edges and the like. The wall members 18 and 20 are easy to manipulate and open in such a way as to enable full access to chamber 22 for ease of insertion and removal of the pacifier 26, as well as ease of cleaning. The unitary construction of housing 12 renders the structure simple in design and inexpensive to fabricate, as well as reliable in use.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A pacifier case for providing a sanitary enclosure for a pacifier of the type having a nipple extending axially from one side of a radial guard flange and a handle extending from the other side of the guard flange, the pacifier case comprising:

a unitary shell-like housing of molded synthetic resin extending axially between a first end and a second end, said housing establishing an enclosed chamber having a first portion, adjacent the first end, for receiving and enclosing the nipple of the pacifier and a second portion, adjacent the second end, for receiving and enclosing the guard flange of the pacifier;

the housing including a pair of half-shell-like wall members having peripheral edges for engaging one another when in a closed position to establish said enclosed chamber;

hinge means joining the wall members along a limited length of the peripheral edges for enabling parting of the wall members at the peripheral edges for selective movement of the wall members to an open position to open the chamber;

the housing including radially-extending end wall portions adjacent the second end thereof; and an aperture in the end wall portions for enabling the handle of the pacifier to project axially through the aperture and outside the chamber beyond the end wall portions, when the wall members are in the closed position.

2. The invention of claim 1 including sealing means having complementary engagable sealing members unitary with and extending along the peripheral edges of the wall members for substantially sealing the chamber against contaminants when the wall members are in the closed position.

3. The invention of claim 1 or 2 wherein the hinge means is located at the first end of the housing such that the wall portions move between the open and closed positions about a hinge axis located at the first end and extending transverse to the axial extent of the housing.

4. The invention of claim 3 wherein the hinge means includes a further wall portion of reduced wall thickness, the further wall portion being coextensive with the hinge axis, between the pair of wall members.

5. The invention of claim 3 wherein the aperture has a profile configuration generally complementary to the handle of the pacifier to substantially complete the sealing of the chamber against contaminants.

6. The invention of claim 5 wherein the end wall portions are located one in each wall member and the profile configuration of the aperture includes symmetrical halves, each half being located in the end wall portion of one wall member.

7. The invention of claim 3 including selectively releasable locking means having complementary locking elements unitary with each wall member and located within the chamber for positively locking the wall members in the closed position.

8. The invention of claim 7 wherein the locking elements are located in the end wall portions.

9. A pacifier case for providing a sanitary enclosure for a pacifier of the type having a nipple extending axially from one side of a radial guard flange and a handle extending from the other side of the guard flange, the pacifier case comprising:

a shell-like housing extending axially between a first end and a second end, said housing establishing an enclosed chamber having a first portion, adjacent the first end, for receiving and enclosing the nipple of the pacifier and a second portion, adjacent the second end, for receiving and enclosing the guard flange of the pacifier;

the housing including a pair of half-shell-like wall members having peripheral edges for engaging one another when in a closed position to establish said enclosed chamber;

hinge means joining the wall members along a limited length of the peripheral edges for enabling parting of the wall members at the peripheral edges for selective movement of the wall members to an open position to open the chamber;

the housing including radially-extending end wall portions adjacent the second end thereof; and an aperture in the end wall portions for enabling the handle of the pacifier to project axially through the aperture and outside the chamber beyond the end wall portions, when the wall members are in the closed position;

the hinge means being located at one of the first and second ends of the housing such that the wall portions move between the open and closed positions about a hinge axis located adjacent said one end and extending transverse to the axial extent of the housing.

10. The invention of claim 9 including sealing means having complementary engagable sealing members unitary with and extending along the peripheral edges of the wall members for substantially sealing the chamber against contaminants when the wall members are in the closed position.

11. The invention of claim 10 wherein the aperture has a profile configuration generally complementary to the handle of the pacifier to substantially complete the sealing of the chamber against contaminants.

12. The invention of claim 11 wherein the end wall portions are located one in each wall member and the profile configuration of the aperture includes symmetrical halves, each half being located in the end wall portion of one wall member.

13. The invention of claim 12 including selectively releasable locking means having complementary locking elements unitary with each wall member and located within the chamber for positively locking the wall members in the closed position.

14. The invention of claim 13 wherein the locking elements are located in the end wall portions.

* * * * *